United States Patent [19]

Odza et al.

[11] 4,136,882

[45] Jan. 30, 1979

[54] DOMAIN GAME WITH ELASTIC PIECE RETENTION

[76] Inventors: Besir Odza; George Spector, both c/o George Spector, 3615 Woolworth Bldg., 233 Broadway, New York, N.Y. 10007

[21] Appl. No.: 714,817

[22] Filed: Aug. 16, 1976

[51] Int. Cl.[2] ..... A63F 3/00

[52] U.S. Cl. ..... 273/264; 273/285; 273/282

[58] Field of Search ..... 273/136 GA, 136 GB, 273/136 G, 136 E, 136 D, 136 K, 282, 283, 285, 286, 287; 206/592

[56] References Cited

U.S. PATENT DOCUMENTS

| | | | |
|---|---|---|---|
| 947,603 | 1/1910 | Steacy | 273/136 G |
| 1,420,334 | 6/1922 | Neuner | 273/136 K |
| 1,499,214 | 6/1924 | Griebel | D34/5 SS |
| 1,595,285 | 8/1926 | Bevan | 273/136 D |
| 2,681,804 | 6/1954 | Stover | 273/136 E |
| 3,251,600 | 5/1966 | Warnberg | 273/136 K |

FOREIGN PATENT DOCUMENTS

| | | | |
|---|---|---|---|
| 24286 of | 1899 | United Kingdom | 273/131 BB |
| 8287 of | 1900 | United Kingdom | 273/136 E |
| 13079 of | 1905 | United Kingdom | 273/136 E |

*Primary Examiner*—Richard C. Pinkham
*Assistant Examiner*—Lawrence E. Anderson

[57] ABSTRACT

A game for being played competitively by two players, and which included a gameboard upon which a playing field with rows of spaces is imprinted, and upon which the players alternately place a playing piece so to try and obtain three playing pieces in a "straight line" or in a "trick track" position.

1 Claim, 7 Drawing Figures

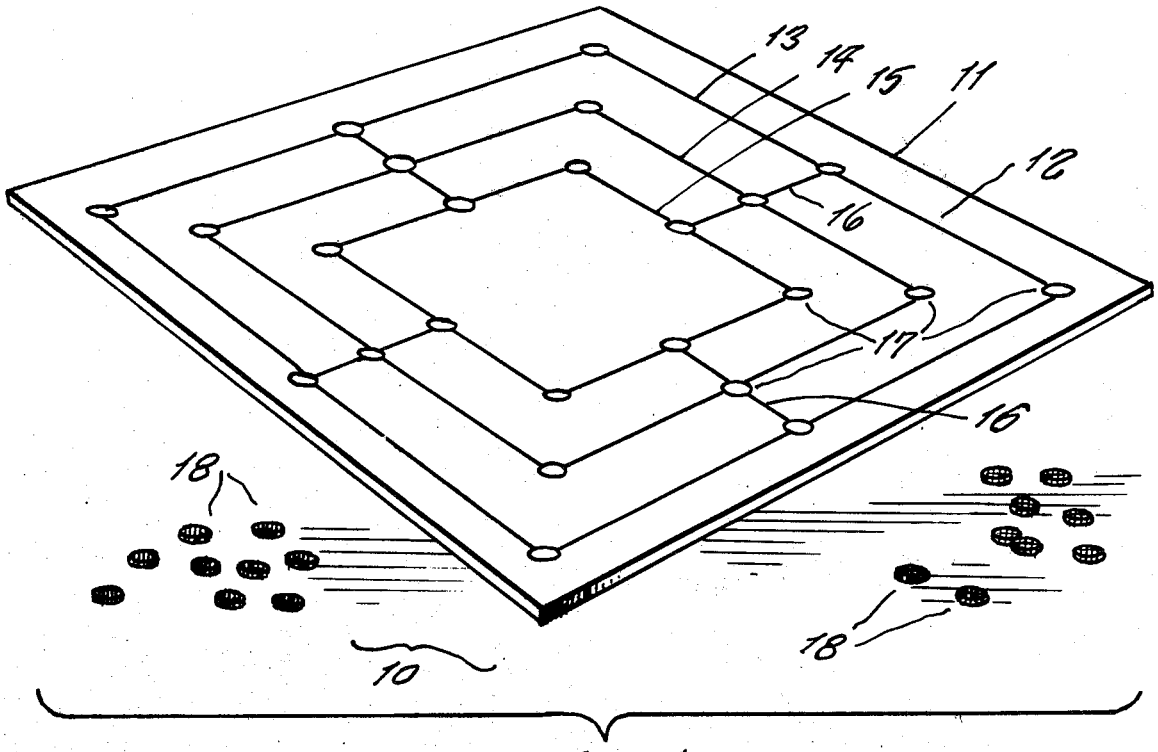
Fig. 1
Fig. 2
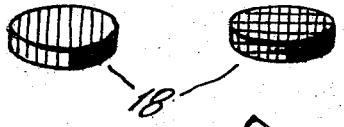
Fig. 3
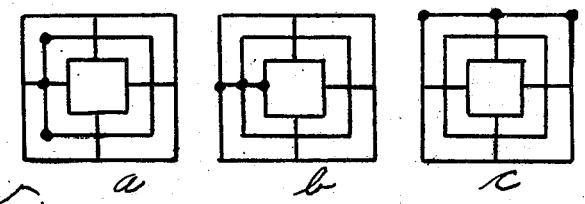
Fig. 5
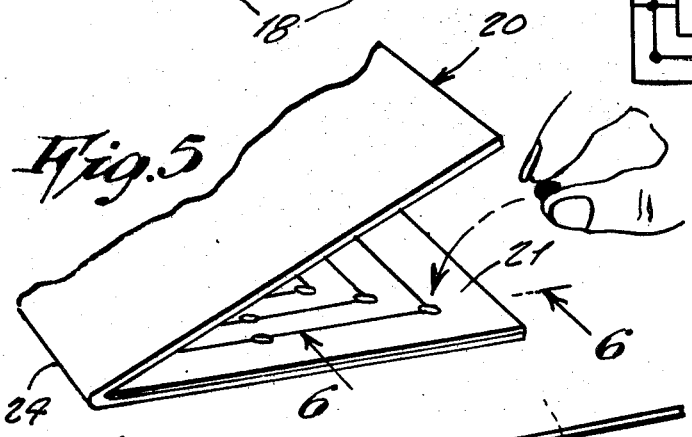
Fig. 4
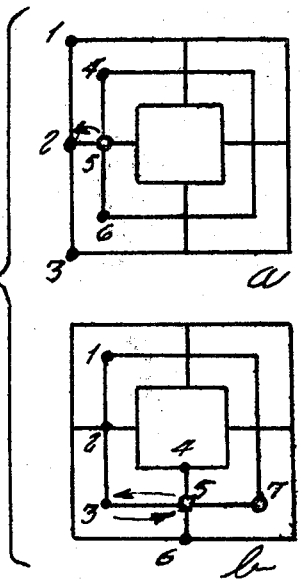
Fig. 6
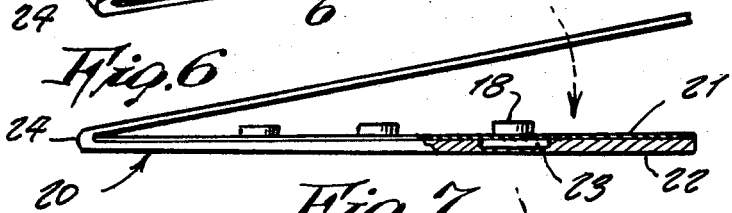
Fig. 7
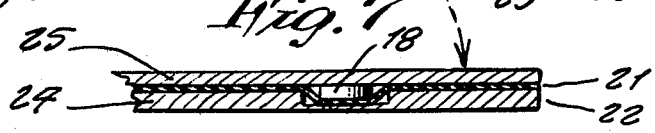

DOMAIN GAME WITH ELASTIC PIECE RETENTION

This invention relates generally to games of board type.

A principal object of the present invention is to provide a board game of DOMAIN which gives diversion and entertainment to players, and which can be played anywhere that the board can be set up, indoors or outdoors.

Another object is to provide a game of DOMAIN which is a pleasant pastime for children and adults and which is easy to learn, while at a same time developing the skill of concentration in order to become a proficient player.

Other objects are to provide a DOMAIN which is simple in design, inexpensive to manufacture, rugged in construction easy to use and efficient in operation.

These and other objects will be readily evident upon a study of the following specification and the accompanying drawing wherein:

FIG. 1 is a perspective view of the game.

FIG. 2 is an enlarged view of one of the red and the black playing pieces.

FIG. 3 shows examples of straight line positions.

FIG. 4 shows examples of trick track positions.

FIGS. 5, 6, and 7 show a modified design of the gameboard in which a resilient flat playing surface is inwardly flexed into a recess by a playing piece, so that when the gameboard is folded up so to be put away after a game, the playing pieces can be stored therewithin upon the playing field spaces; thus requiring no additional storage box, and also allowing an unfinished game to be put away so to be continued later, such as when playing on a public vehicle such as a train or etc.

Referring now to the drawing in detail, and more particularly to FIGS. 1 through 4, the reference numeral 10 represents a game of DOMAIN according to the present invention wherein there is a game board 11 having a playing field 12 imprinted thereupon consisting of three concentric squares 13, 14, and 15 which at a center of each side are enjoined together by cross lines 16.

The game also includes a set of playing pieces for placement upon the playing field at junctions of lines which thus comprise playing spaces 17. There is a total of 18 playing pieces 18 divided into two teams of nine each. One team is colored red and the other is black. Each player controls one team. The playing pieces may be disc shaped, as shown.

In FIGS. 5 through 7, a modified design of game board 20 is comprised of a flexible rubber sheet 21 mounted on a rigid back board 22 having depressions 23 on a side facing the sheet 21. The playing field is imprinted on the sheet 21, and the game board is foldable along a central fold 24 in a manner of conventional game boards, for easy storage. The depressions are aligned with the playing spaces and are larger than a size of the playing pieces, so that in case a game is incomplete before being put away the playing piece positions can be retained; the game board simply being folded into a closed position, in which case the rubber sheet is stretched allowing the playing pieces to rest in the depressions, as shown, when the opposite sides of the game board are brought together closed. Thus no additional storage box is needed for storing the playing pieces. Alternately, as shown, the sheet 21 and depressions 23 may be made only on one of the panels 24 of the gameboard while the other panel 25 is without them.

In playing the game each player in succession places one piece on a playing space of the playing field until all are put out. If by chance one of the players get three pieces in a straight line horizontally or vertically, he can then take one piece of the other player that is on the board. Each player tries to stop the other from making a straight line. If a player succeeds to get a straight line, it is called a "doam."

After all pieces are down on the board, the players then in succession move pieces one at a time on the playing field so to form new positions in order to obtain either a "straight line" of three pieces as suggested in FIG. 3, or a "trick track" in which a pattern is obtained or suggested in the examples illustrated in FIG. 4. A player who succeeds with all pieces in this is declared a winner.

In diagram (*a*) of FIG. 4, numbers 1, 2, and 3, are a straight line. If you make a line like these three pieces or any such line like is shown here you could take one piece off the other player. Numbers 1–6 represent a trick-track. Number 5 has no piece since you could move number 2 to number 5 and make a straight line and you could get a piece from the other player, and you just keep moving it from number 5 to number 2, and then from number 2 to number 5 until you get all the pieces that the other player has. You could do this, but if the other player has a piece near number 5, he could block number 5 and then you could not do this anymore.

In diagram (*b*) of FIG. 4, numbers 1, 2, and 3, are a straight line. If you make this kind of a line with these three pieces like the line shown in the drawing you take one piece of the other player. Numbers 1–6 represent a trick-track. Number 5 has no piece in there, since you could move number 3 in number 5 make a straight line and take one piece from the other player. You could repeat this over and over, number 5 in number 3, number 3 in number 5, and you could do this as long as you have to until you take all the other players pieces. But if the other player has a piece in number 7, when you move the piece from number 5 to number 3, the other player could block your trick-track by putting his piece number 7 to number 5.

Thus there is provided a novel game.

While various changes may be made in the detail construction, it is understood that such changes will be within the spirit and scope of the present invention, as is defined by the appended claims.

What is claimed is:

1. A DOMAIN GAME, comprising in combination a game board having a playing field imprinted on one side consisting of three concentric squares with interconnecting cross lines at a center of each side thereof, and a set of eighteen playing pieces divided into two differently colored teams of nine pieces each wherein said board comprises a pair of panels which fold together along a central line including an emperforate, elastic sheet mounted flush on one panel, said elastic sheet having said playing field imprinted thereon and said one panel having a depression under each complete playing space of said playing field, said depressions being slightly larger than the playing pieces in circumference and of depth equal to the combined depth of a piece and thickness of said sheet whereby said panels are movable from an open playing position in which said pieces rest on said elastic sheet to a closed storage position wherein some of the playing pieces are forced into said depressions when the second panel engages the pieces to thereby retain them in said depressions with the pieces being flush with the second said panel and playing field.

* * * * *